US006279434B1

(12) United States Patent
Brown

(10) Patent No.: US 6,279,434 B1
(45) Date of Patent: Aug. 28, 2001

(54) SKATEBOARD TOOL

(76) Inventor: David H. Brown, 1980 Diamond St., San Marcos, CA (US) 92069

( * ) Notice: Subject to any disclaimer, the term of this patent is extended or adjusted under 35 U.S.C. 154(b) by 0 days.

(21) Appl. No.: 09/612,936

(22) Filed: Jul. 10, 2000

(51) Int. Cl.[7] ..... B25B 23/00

(52) U.S. Cl. ..... 81/437; 81/439; 81/490; 81/177.4

(58) Field of Search ..... 81/437–439, 490, 81/177.4; 7/138, 165

(56) References Cited

U.S. PATENT DOCUMENTS

| | | | |
|---|---|---|---|
| 4,774,736 | 10/1988 | Brawner et al. . | |
| 4,926,741 | 5/1990 | Hsiao . | |
| 5,285,543 | 2/1994 | Rowe . | |
| 5,524,513 | 6/1996 | Barahona . | |
| 5,592,862 * | 1/1997 | Macor | 81/439 |
| 5,778,896 | 7/1998 | Seals et al. . | |

FOREIGN PATENT DOCUMENTS

| | | |
|---|---|---|
| 569859 | 6/1945 | (GB) . |
| WO 89/03282 | 4/1989 | (WO) . |

* cited by examiner

*Primary Examiner*—James G. Smith
(74) *Attorney, Agent, or Firm*—Richard C. Litman

(57) ABSTRACT

The present invention is directed to a tool for use on a skateboard and easily carried in a pants pocket of a user. The tool has a body is in the general shape of a "T" having a crossbar bisected by a stem and provides for three sockets of differing sizes, one of each being mounted at each end of the crossbar and the free end of the stem. Provision is also made for carrying a combination Allen key and Phillips head screwdriver and is in the general form of a standard Allen wrench having a long arm and a short arm normal to the long arm. This provision constitutes a cylindrical cavity with an opening at the intersection of the crossbar and stem and extending into the stem for distance adequate to accommodate the long arm of the combination Allen key and Phillips head screwdriver, which preferably is the Phillips head portion. This provision also provides a groove extending along the surface of the crossbar of such size and shape to accommodate the short arm of the combination Allen key and Phillips head screwdriver, which preferably is the Allen key portion. An "O" ring is positioned within the cylindrical cavity to provide a friction fit with the Phillips head screwdriver portion of the combination Allen key and Phillips head screwdriver. An "O" ring may be positioned circumferentially on the Allen key portion so as to provide an improved fit within the corresponding groove as an alternative or in conjunction with the cylindrical cavity "O" ring.

8 Claims, 5 Drawing Sheets

SKATEBOARD TOOL

BACKGROUND OF THE INVENTION

1. Field of the Invention

The present invention relates to specialty tools and accessories for sporting goods, and particularly to a multifunction skateboard tool for use in repairing and adjusting skateboards.

2. Description of the Related Art

In recent years skateboarding has become a popular leisure time activity. Skateboards frequently require maintenance, particularly when used in competitive events which require jumps and other athletic maneuvers. The skateboard may require adjustment or repair, which necessitates using socket wrenches of different sizes, a Phillips head screwdriver and/or an Allen key for securing the fasteners which retain the skate on the board, adjusting the axles, etc. The typical skateboarder does not want to be burdened by carrying around a tool box or a plurality of tools. There is a need for a combination, multifunction skateboard tool which is compact in size and lightweight for easy portability, and preferably pocket size so that it may be conveniently carried by the skateboarder. The related art describes various tool configurations combining multiple functions. The art of interest will be discussed in the order of their perceived relevance to the present invention.

U.S. Pat. No. 4,747,736, issued on Oct. 4, 1988 to William H. Brawner et al., describes a tool kit for use by a skateboarder, providing two sockets, two screw driver heads and an Allen wrench for use in repairing or adjusting skateboards. The Allen wrench is deployed by separating two portions of the body of the tool kit, thus exposing the Allen wrench. This patent is distinguished from the present invention by its lack an elongated handle for the Allen key and in that it provides for only two sockets while the present invention provides for three different sockets.

U.S. Pat. No. 4,926,721, issued on May 22, 1990 to K. H. Hsiao, describes a tool kit having a variety of tool heads such as a screwdriver and a socket, all located within the handle of the "T" shaped body of the kit. This patent is distinguished from the present invention by its lack of provision for an Allen key.

U.S. Pat. No. 5,285,543, issued on Feb. 15, 1994 to Robert G. Rowe, describes a generally "T"-shaped tool kit having two fixed sockets and a fixed screwdriver at the respective remote ends of the tool body. Provision is made for a file to be stored within the lower portion of the "T" and is deployable by extending it out of the body to a releasably fixed position. This patent is distinguished from the present invention by its lack of provision for an Allen key and in that it provides only two fixed sockets.

U.S. Pat. No. 5,524,513, issued on Jun. 11, 1996 to R. J. Barahona, describes an in-line skate wheel and bearing tool having an Allen wrench storage cavity within the handle, a series of concentric staggered bearing tools and an Allen wrench tip. This patent is distinguished from the present invention by its lack of provision for any sockets as is required for skateboard adjustment or repair.

U.S. Pat. No. 5,524,513, issued on Jul. 14, 1998 to Seals et al., describes a combination smoking pipe and tool kit having a variety of sockets and a double ended screwdriver storable within the pipe stem having a standard blade head at one end and a Phillips head on the other end. This patent is distinguished from the present invention in that no Allen key is provided. The double ended screwdriver must be removed before the kit is useful as a pipe and is subject to loss when employed in the smoking mode.

British Patent specification 569,859, published on Jun. 12, 1945, describes a combination tool having four tool heads held by a circular body. As shown, three Allen wrench heads and a screwdriver head are held by the circular body. This patent is distinguished from the present invention in that no sockets are provided by the patented device.

International patent WO 89/03282, published on Apr. 20, 1989, describes a tool kit with an elongated body serving as a handle and capable of holding a single screwdriver head selected from a plurality of screwdriver heads of differing configuration stored within a magazine located within the handle. This specification is distinguished from the present invention in that it fails to provide for sockets or an Allen key and contains many separable parts which are subject to loss.

None of the above inventions and patents, taken either singularly or in combination, is seen to describe the instant invention as claimed. Thus a skateboard tool solving the aforementioned problems is desired.

SUMMARY OF THE INVENTION

The present invention is directed to a tool for use on a skateboard and easily carried in a pants pocket of a user. The tool has a body that is in the general shape of a "T" having a crossbar bisected by a stem and provides for three sockets of differing sizes, one of each being mounted at each end of the crossbar and at the free end of the stem. Provision is also made for carrying a combination Allen key and Phillips head screwdriver and is in the general form of a standard Allen wrench having a long arm and a short arm normal to the long arm. This provision constitutes a cylindrical cavity with an opening at the intersection of the crossbar and stem and extending into the stem for a distance adequate to accommodate the long arm of the combination Allen key and Phillips head screwdriver, which preferably is the Phillips head portion. This provision also provides a groove extending along the surface of the crossbar of such size and shape to accommodate the short arm of the combination Allen key and Phillips head screwdriver, which preferable is the Allen key portion. An "O" ring is positioned either about the short arm of the combination Allen key-Phillips head screwdriver for frictionally fitting the groove in the crossbar, or within the cylindrical cavity to provide a friction fit with the Phillips head screwdriver portion of the combination Allen key and Phillips head screwdriver.

Accordingly, it is a principal object of the invention to provide a skateboard tool capable of being easily carried by the user.

It is another object of the invention to provide a skateboard tool having a multiplicity of tool heads for engagement with various elements of the skateboard such as nuts and screws.

It is a further object of the invention to provide a skateboard tool in the form of a "T" and having a socket for engagement with a nut located on each remote end of the three members forming the "T", each socket being a different size to allow engagement with nuts of three different sizes that may be present on the skateboard.

Still another object of the invention is to provide a combination Allen key and Phillips head screwdriver carried within the skateboard tool and separable therefrom for use.

Still another object of the invention is to provide a skateboard tool having a cylindrical cavity extending from the intersection of the "T" elements axially into one of the elements and to provide a friction fit sufficient to retain a combination Allen key and Phillips head screwdriver element when that element is not in use.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

The present invention is a "T" shaped tool useful in the repair and adjustment of skateboards. The inventive tool has a crossbar bisected by a stem and provides for three sockets of differing sizes, one of each being mounted at each end of the crossbar and at the free end of the stem. Provision is also made for carrying a combination Allen key and Phillips head screwdriver element and is in the general form of a standard Allen wrench having a long arm and a short arm normal to the long arm. This provision constitutes a cylindrical cavity extending into the stem and a groove extending along the surface of the crossbar useful for storage of the combination Allen key and Phillips head screwdriver when not in use.

Figure 1:
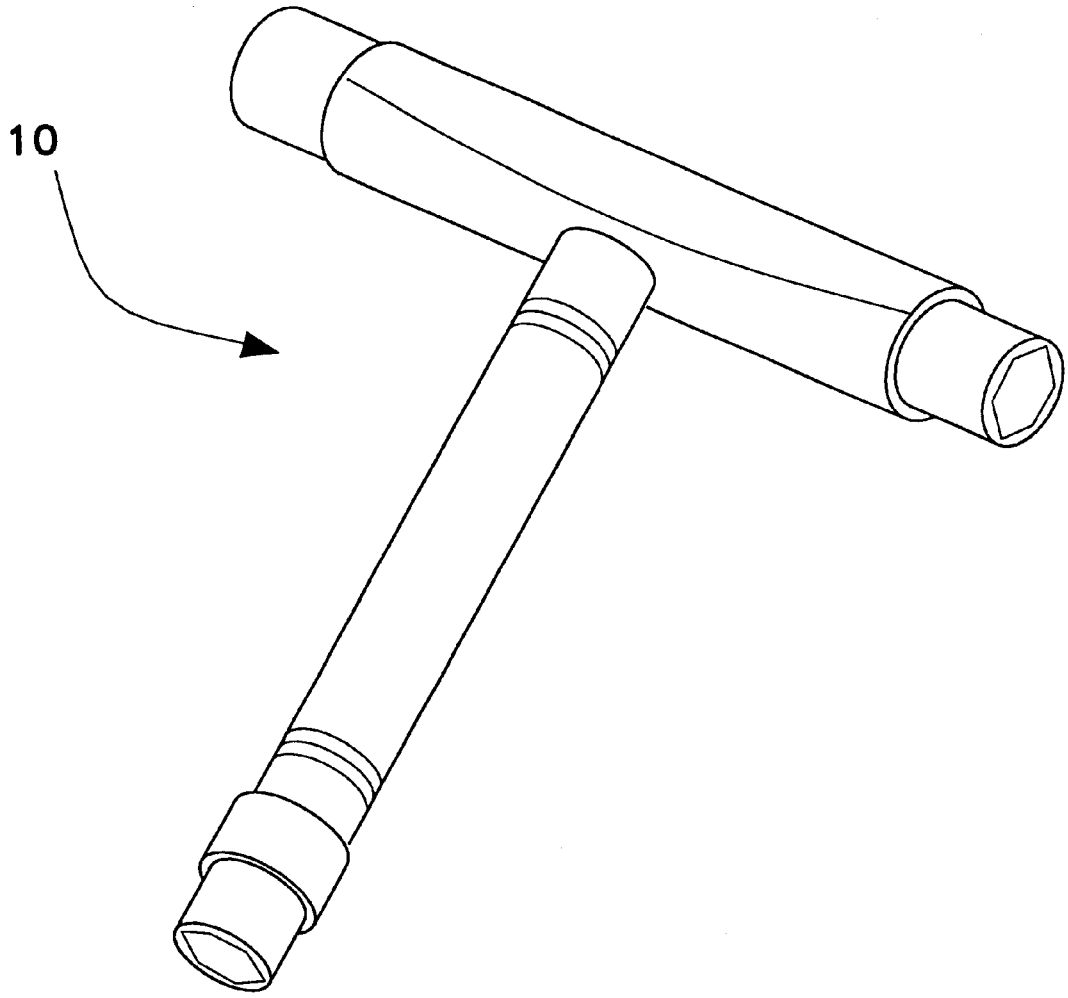
FIG. 1 is an environmental, perspective view of a skateboard tool according to the present invention.
Figure 2:
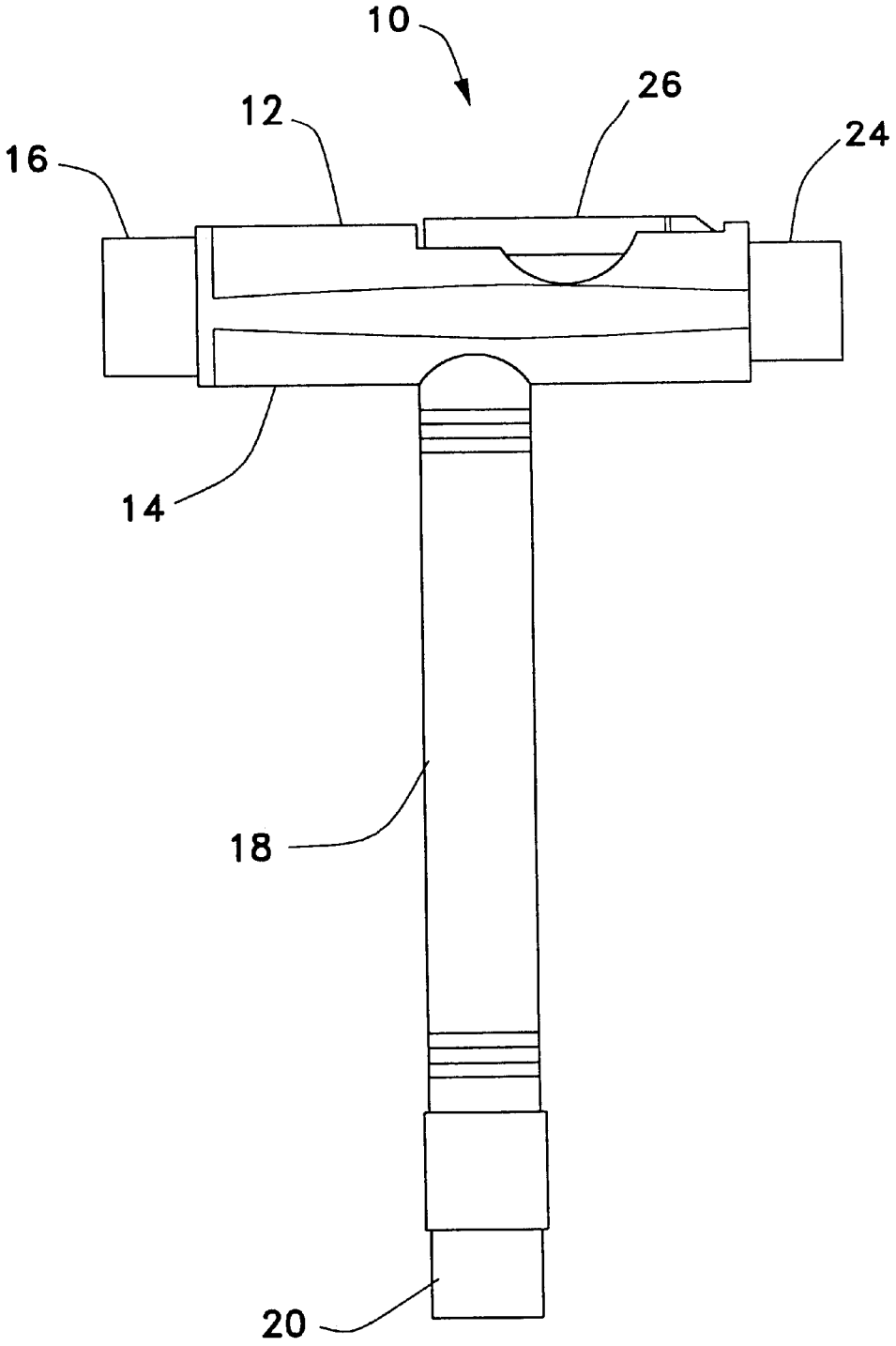
FIG. 2 is an elevation view of the skateboard tool of FIG. 1.
Figure 3:
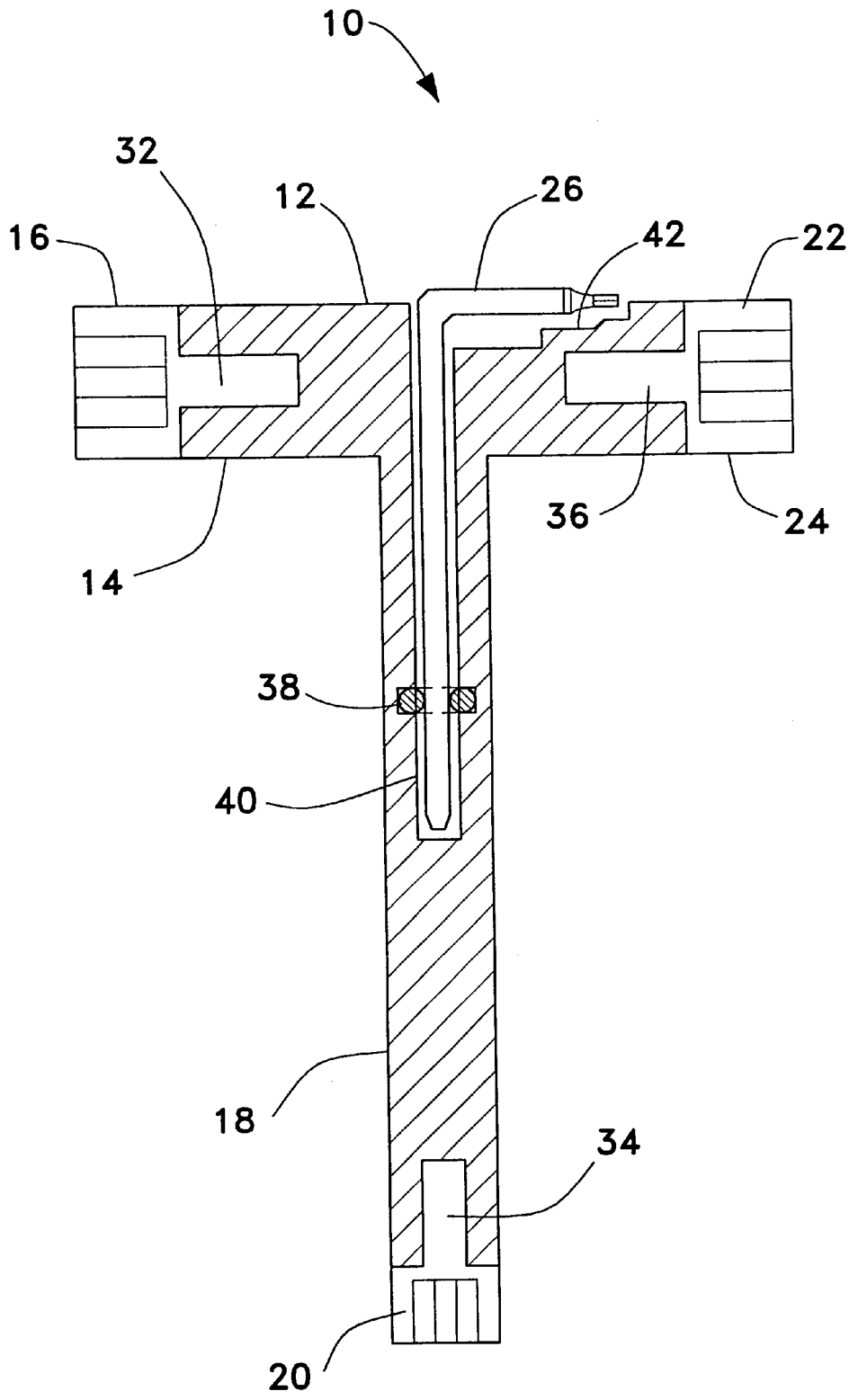
FIG. 3 is a vertical section view of a skateboard tool according to the present invention.

Referring to FIGS. 1 and 2, skateboard tool 10 includes "T" shaped body 12 having a crossbar 14 bisected by a stem 18 and provides for first socket 16, second socket 20, and third socket 24 each of differing respective size, one of each being mounted at each end of the crossbar 14 and the free end of the stem 18, respectively. As shown in FIG. 3, crossbar 14 has a groove 42 defined in one arm of the crossbar 14.

Figure 2A:
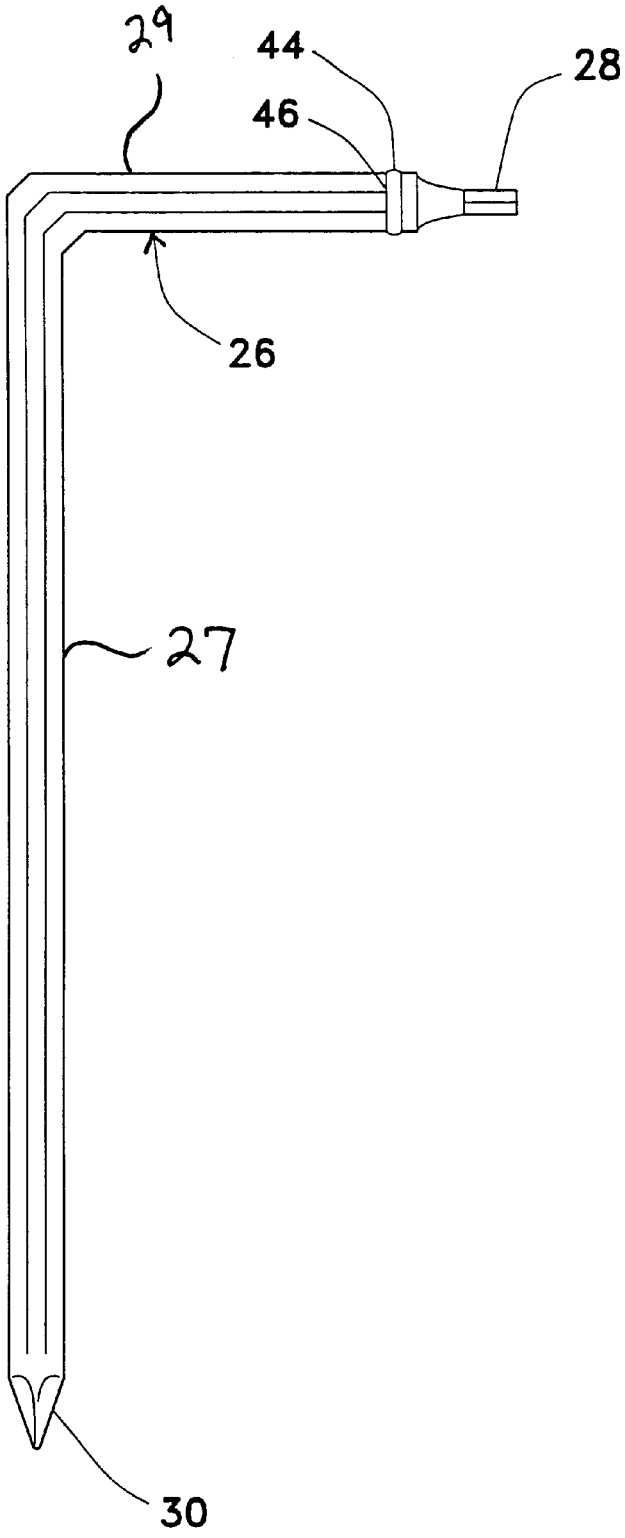
FIG. 2A is a detail view of the Allen key and Phillips head screwdriver portion of the skateboard tool according to the present invention.

Referring to FIGS. 2 and 2*a*, the combination Allen key and Phillips head screwdriver 26 is in the general form of a standard Allen wrench having a long arm 27 which terminates in a Phillips head 30, and a short arm 29 which preferably terminates in an Allen head 28 and is normal to the long arm 27. "O"-ring 44 is located on the short arm 29 of the body of combination tool 26 within annular slot 46 adjacent the Allen head 28. In a preferred 0-ring 44 serves to frictionally retain the combination Allen key-Phillips head screwdriver 26 in groove 42, as best shown in FIG. 3.

Figure 3A:
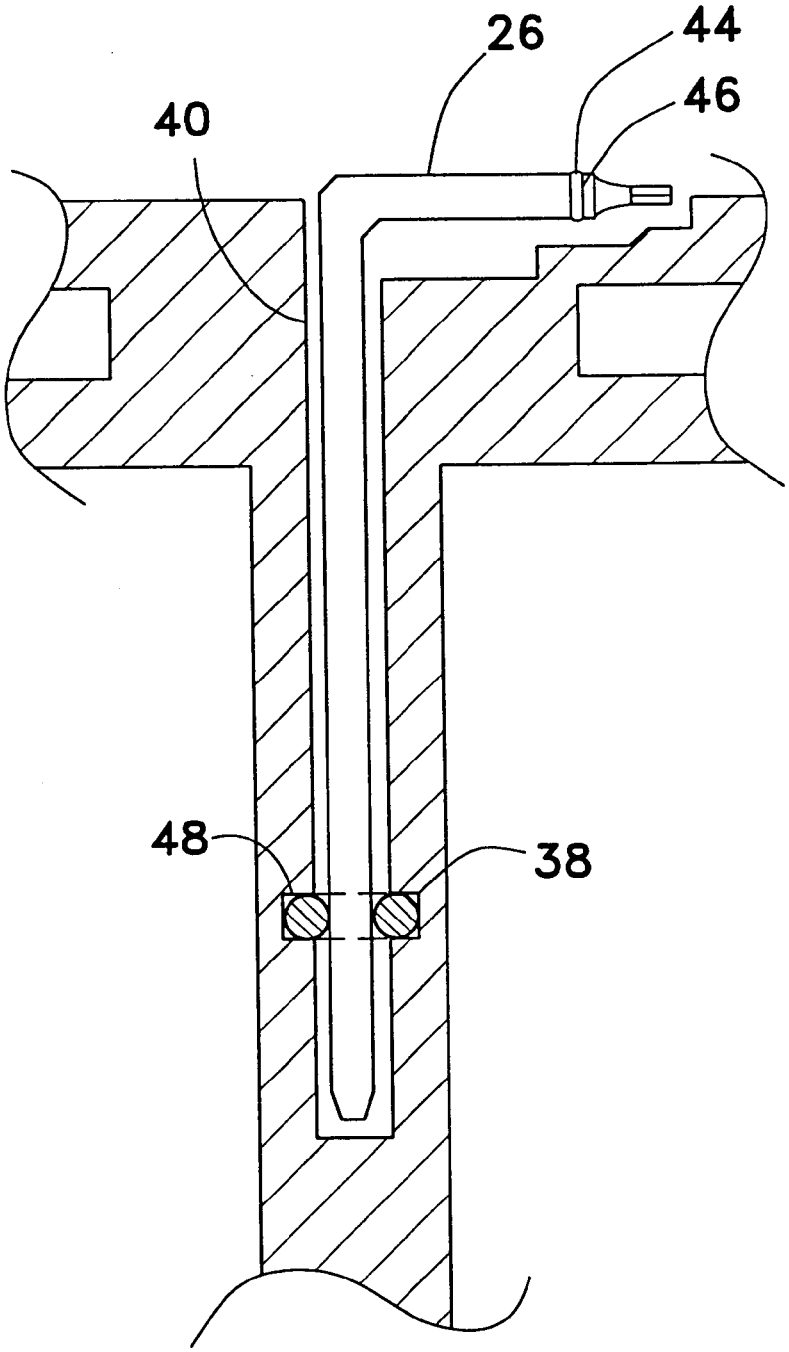
FIG. 3A is a detail view showing alternate placements of the "O" ring for securing the combination tool insert.

Referring to FIGS. 3 and 3*a* there is shown a cross-sectional view and a detail view, respectively, of skateboard tool 10 further illustrating the invention. As is seen in the drawing, first socket 16 is mounted at one end of crossbar 14 by means of first non-rotatable socket mount 32, second socket 20 is mounted at the free end of stem 18 by means of second non-rotatable socket mount 34, and third socket 24 is mounted at the opposite end of crossbar 14 by means of third non-rotatable socket mount 36. Allen key and Phillips screwdriver 26 may optionally be retained in the T-shaped body 12 by "O" ring 38 within cylindrical cavity 40, this cavity having an opening at the intersection of the crossbar 14 and stem 18 and extending into the stem 18 for a distance adequate to accommodate the long arm 29 of the combination Allen key and Phillips head screwdriver 26. Groove 42 extends along the surface of crossbar 14 and is of such size and shape to accommodate the short arm 27 of combination Allen key and Phillips head screwdriver 26. As seen in detail FIG. 3*a* "O" ring 38 is held in position near the opening of cavity 40 by circumferential "O" ring seat 48 located circumferentially within the wall of cavity 40.

In use, skate tool 10 is storable on a user's belt or in the user's pocket. When employed to work on a skateboard, first socket 16, second socket 20 and third socket 24 may be used and preferably provide a range of sizes including a 9/16 inch socket as socket 16, a 3/8 inch socket as socket 20 and a 1/2 inch socket as socket 24. Each socket is held in appropriate recesses of their respective elongate members by non-rotatable socket mounts 32, 34, and 36 so as to allow their use to turn nut or screw heads of their respective size on a skateboard by grasping "T" shaped body 12 in an appropriate manner so as to serve as a wrench. Allen key and Phillips head screwdriver 26 are of an appropriate size to be useful in working on a skateboard. When not in use, Allen key and Phillips head screwdriver 26 is preferably stored with the long arm 27 within cylindrical cavity 40 and the short arm 29 positioned within groove 42 and held by "O" ring 44.

"T" shaped body 12 may be made of an appropriate material such as plastic or metal and is of an appropriate size, the length of stem 18 being preferably about four inches, and that of crossbar 14 being somewhat shorter than eight inches in length. Sockets 16, 20, and 24 and respective non-rotatable socket mounts 23, 34, and 36 are preferably made of an appropriate metal material. Allen key and Phillips head screwdriver 26 is of an appropriate size to be useful in the repair of skateboards and is made of an appropriate material such as metal. "O" ring 38 is of rubber or similar material and is sized so as to hold the Phillips head screwdriver portion of combination Allen key and Phillips head screwdriver 26 by friction, but to allow the same to be pulled out of cylindrical cavity 40 for use. As is seen in FIG. 3*a*, "O" ring 38 is held by "O" ring seat 48 in "T" shaped body 12 near the entrance of cylindrical cavity 40. "O" ring 38 and "O" ring 44 may be employed in the same embodiment of the invention or as alternatives in other embodiments as desired.

It is to be understood that the present invention is not limited to the embodiment described above, but encompasses any and all embodiments within the scope of the following claims.

I claim:

1. A skateboard tool comprising:

a "T" shaped body formed by a crossbar bisected by a stem, said crossbar having opposite ends and an upper surface defining a groove, said stem having a cylindrical cavity with an opening at the intersection of said crossbar and an opposite free end, said body having first and third sockets non-rotatably mounted at the respective ends of said crossbar, and a second socket non-rotatably mounted at the free end of said stem; and a combination Allen key and Phillips head screwdriver element having a long arm and a short arm normal to said long arm, said combination element being removably insertable in said body such that said long arm extends into the cylindrical cavity of said stem and said short arm is positioned within the groove of the crossbar.

2. The skateboard tool of claim 1 wherein each of said sockets differs in size from each of the other said sockets.

3. The skateboard tool of claim 1 wherein said long arm of said combination element is Phillips head portion.

4. The skateboard tool of claim 1 wherein said short arm of said combination element is a Allen key portion.

5. The skateboard tool of claim 1 further comprising a "O" ring mounted within a circumferential seat located within said cylindrical cavity and so positioned as to provide a friction fit to retain said long arm of said combination Allen key and Phillips head screwdriver element.

6. The skateboard tool of claim 1 further comprising an "O" ring mounted within an annular slot surrounding said short arm of said combination element for frictionally retaining said short arm in the groove defined in said crossbar.

7. The skateboard tool of claim 5 further comprising an "O" ring mounted within an annular slot surrounding said short arm of said combination element for frictionally retaining said short arm in the groove defined in said crossbar.

8. The skateboard tool of claim 2 wherein said first socket is a 9/16 inch socket, said second socket is a 3/8 inch socket, and said third socket is a 1/2 inch socket.

* * * * *